United States Patent [19]

Lee

[11] Patent Number: 4,703,768

[45] Date of Patent: Nov. 3, 1987

[54] UMBRELLA DRIP CUP WITH DISCHARGE VALVE

[76] Inventor: Ching-Chang Lee, P.O. Box 70-217, Taipei, Taiwan

[21] Appl. No.: 797,469

[22] Filed: Nov. 12, 1985

[51] Int. Cl.[4] ..... A45B 25/28

[52] U.S. Cl. ..... 135/48

[58] Field of Search ..... 135/44, 48

[56] References Cited

U.S. PATENT DOCUMENTS

| | | | |
|---|---|---|---|
| 722,573 | 3/1903 | Flynn | 135/48 |
| 1,264,049 | 4/1918 | Frazer | 135/48 |
| 2,808,066 | 10/1957 | Pugliese | 135/48 |

FOREIGN PATENT DOCUMENTS

| | | | |
|---|---|---|---|
| 590030 | 6/1925 | France | 135/48 |
| 358461 | 4/1938 | Italy | 135/48 |
| 7258 | of 1889 | United Kingdom | 135/48 |

*Primary Examiner*—Robert A. Hafer
*Assistant Examiner*—D. Neal Muir

[57] ABSTRACT

An inverted-frustoconical container houses a clamp for clamping the tip of an umbrella, and a rain-water drain valve. The drain valve is normally biased closed, but downward force on the container opens the valve. When the umbrella tip is held in the clamp and the umbrella is stood tip-downward in the container, any rain water accumulated on the umbrella cloth runs into and is collected within the container. To drain the collected water from the container, a user bears downward on the umbrella shaft to force the container against the floor or ground and thereby open the valve.

4 Claims, 4 Drawing Figures

UMBRELLA DRIP CUP WITH DISCHARGE VALVE

BACKGROUND OF THE INVENTION

After folding a conventional umbrella in a rainy day, the water drained from the umbrella cloth may wet the ground to influence the housekeeping in a room or office. Conventional rain-water collector for umbrella is quite complex in structure and its cost also seems expensive for the user. The present inventor has found the defect of conventional umbrella and its rain-water collector, and invented the present rain-water disposer for umbrella.

SUMMARY OF THE INVENTION

The object of the present invention is to provide a rain-water disposer including an inverse truncated-cone container, a tip clamp and a drain valve, wherein the tip of umbrella is held by the tip clamp to drain the rain-water accumulated on umbrella cloth into the container and then, the collected water is discharged through the drain valve for better housekeeping purpose.

DETAILED DESCRIPTION

Figure 1:
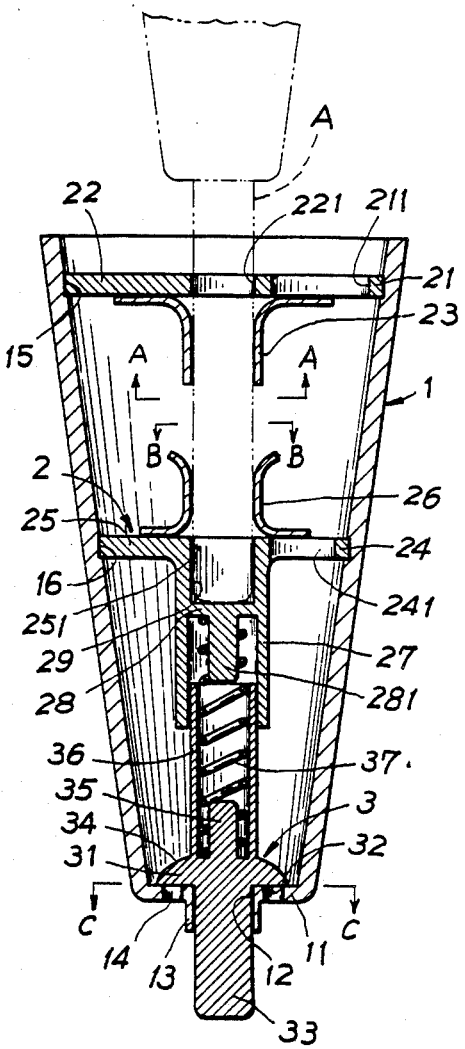
FIG. 1 is a sectional drawing of the present invention.
Figure 3:
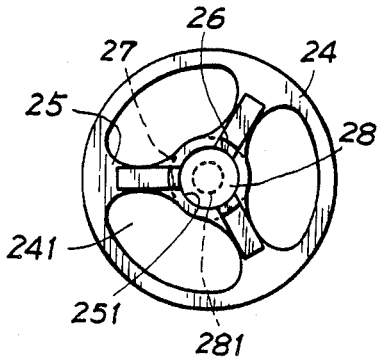
FIG. 3 is an illustration of this invention viewed from BB direction of FIG. 1.
Figure 2:
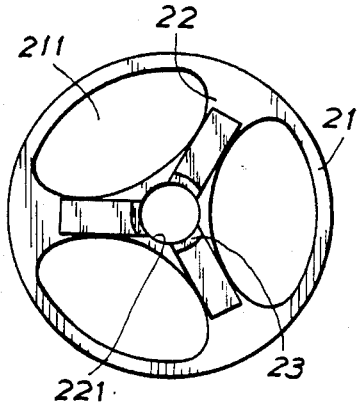
FIG. 2 is an illustration of the present invention as viewed from AA direction of FIG. 1.
Figure 4:
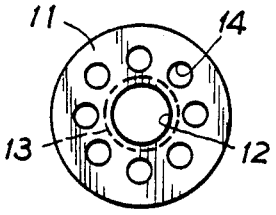
FIG. 4 is an illustration of the present invention as viewed from CC direction of FIG. 1.

As shown in the figures, the present invention comprises an inverse truncated-cone container 1, a tip clamp 2 and a drain valve 3.

The inverse truncated-cone container 1 includes: a bottom plate 11 having a central hole 12, an extension 13 disposing around the hole 12 and a plurality of drain holes 14 on the plate 11; an upper ring groove 15 formed on the upper perimeter inside the container 1; and a middle ring groove 16 formed on the middle perimeter inside the container 1.

The tip clamp 2 includes: an upper ring 21 engaged with the upper ring groove 15 of container 1, a lower ring 24 engaged with the middle ring groove 16 of container 1, a first resilient chuck 23, a second resilient chuck 26, and a lower sleeve 27.

The upper ring 21 is formed with a trifurcate spoke 22 within the ring to form three radial holes 211 and formed with a central collar 221 disposed by spoke 22. The first resilient chuck 23 is secured to the bottom surface of the spoke 22.

The lower ring 24 is formed with another trifurcate spoke 25 within the ring to form another set of three radial holes 241, and formed with another central collar 251 disposed by the spoke 25. The second resilient chuck 26 is secured to the upper surface of the spoke 25.

Both collars 221, 251 are adapted for the insertion of the tip A of conventional umbrella, and may also be threaded to engage with the threaded tip of a conventional umbrella. Both chucks 23, 26 are also adapted to resiliently clamp the tip A.

The lower sleeve 27 is formed under the central bottom surface of the lower ring 24 and includes a central stem 281 extending downwards from a bottom plate 28 within the sleeve, and a socket 29 extending downwards from the collar 251 and adapted for resting the end of umbrella tip A on the bottom plate 28.

The drain valve 3 includes a valve disc 31 having an upper arched surface 34 and a flat bottom surface 32 operatively sealing the holes 14, a lower stem 33 protruding downwards through the central hole 12 of bottom plate 11 from the disc 31, an upper sleeve 36 extending upwards from the disc 31 to be movably inserted in the sleeve 27, a central stem 35 extending from the disc 31 within the sleeve 36, and a restoring spring 37 respectively jacketed on both stems 281, 35 to tension the disc 31 to allow the flat bottom surface 32 normally sealing the drain holes 14 of bottom plate 11.

When using the present invention for disposing the rain water accumulated on the umbrella cloth, the tip A of umbrella is inserted into the two collars 221, 251 and clamped by the two chucks 23, 26, and the rain water will be drained through the holes 211, 241 and collected in the container 1. After a time period, the umbrella handle is pressed downwards by bearing the lower stem 33 against the floor or ground, whereby the rain water collected within the container 1 will be discharged through the holes 14 as the bottom plate 11 lowered from disk 31 to open the hole 14.

The present invention has the following advantages:

1. The present invention may be used in combination with any conventional umbrella.

2. The rain water from the umbrella is easily collected and conveniently disposed without contaminating the surrounding.

3. The present invention can be suitably designed to serve as a novel ornament added on conventional umbrella.

4. The structure is simple and its weight is also light for economic production and for convenient handling.

What is claimed is:

1. A rain-water disposer for an umbrella that has a tip, comprising:

a container in the form of an inverted frustum of a cone, defining an inner conical surface with an upper perimeter, a middle perimeter, and a bottom aperture; and including:

an inner plate disposed across the inner surface of the frustoconical container near the bottom aperture, hole means defined in the plate for passage therethrough of such rain water and for protrusion therethrough of ground-bearing means recited hereunder, an upper ring groove formed in the upper perimeter inside said container, and a middle ring groove formed in the middle perimeter inside said container;

a tip clamp disposed within the frustoconical container and including:

an upper ring engaged with said upper ring groove of said container and including at least three upper spokes within said upper ring, defining a corresponding number of radial holes between the upper spokes, and also including a central upper collar disposed adjacent to said spokes, a resilient upper chuck secured to the upper ring, a lower ring engaged with said middle ring groove of said container and including at least three lower spokes within said lower ring, defining a corresponding number of radial holes between the lower spokes, and also including a central lower collar disposed adjacent to said lower spokes, a resilient lower chuck secured to the lower ring, a vertical sleeve depending from the lower ring and having a top open end and a lower surface, a transverse member within the sleeve below the top open end, and cooperating with the sleeve to define an upward-facing socket, adapted for receiving such an umbrella tip, and a first force-receiving surface defined on the lower surface of the sleeve, both said collars being adapted for the insertion of such an umbrella tip and both said chucks being adapted for clamping such an umbrella tip;

a drain valve operatively formed with the inner plate, and including:

a valve core operatively sealing said hole means, and having an upper surface, and having ground-bearing means protruding downward through said hole means of said inner plate, a second force-receiving surface defined on the upper surface of said core, and a resilient restoring member disposed to apply force between the two force-receiving surfaces to bias said valve core to normally seal said hole means;

whereby, upon depression of such an umbrella tip to bear said ground-bearing means forcibly against the floor or ground, the inner plate of said container will be lowered to at least partially open the hole means and thereby discharge the collected rain water after such rain water has drained through the radial holes of said two rings.

2. A rain-water disposer according to claim 1, particularly for use with such an umbrella of a conventional type that has a threaded tip, wherein:

each of said two collars is threaded to engage with such a threaded tip.

3. A rain-water disposer for an umbrella that has a tip, comprising:

a container in the form of an inverted frustum of a cone, defining an inner conical surface with an upper perimeter, a middle perimeter, and a bottom aperture; and including:

an inner flange disposed near the bottom aperture of the frustoconical container and defining a central hole, an extension disposed around said central hole, a plurality of drain holes defined in said flange, an upper ring groove formed on the upper perimeter inside said container, and a middle ring groove formed on the middle perimeter inside said container;

a tip clamp disposed within the frustoconical container and including:

an upper ring engaged with said upper ring groove of said container and including three upper spokes within said upper ring, defining three radial holes between the upper spokes, and also including a central upper collar disposed adjacent to said spokes, a resilient upper chuck secured to the bottom surface of said upper spokes, a lower ring engaged with said middle ring groove of said container and including three lower spokes within said lower ring, defining another three radial holes between the lower spokes, and also including a central lower collar disposed adjacent to said lower spokes, a resilient lower chuck secured to the upper surface of said lower spokes, a first vertical sleeve depending from the bottom surface of said lower ring and having top and bottom open ends, a transverse wall within the sleeve partway between the top and bottom open ends, and cooperating with the sleeve to define an upward-facing socket, adapted for receiving such an umbrella tip, and a first central spring-anchor pin extending downward from the transverse wall within said first sleeve, both said collars being adapted for the insertion of such an umbrella tip and both said chucks being adapted for clamping such an umbrella tip;

a drain valve operatively formed with the flange, and including:

a valve disc having an upper arched surface and a flat bottom surface operatively sealing said drain holes, a lower stem protruding downward through said central hole of said flange, a second sleeve extending upward from said disc to be movably inserted into said first sleeve, and a second central spring-anchor pin extending upward from the disc within said second sleeve, and a restoring spring respectively jacketed on both said central spring-anchor pins to bias said disc to normally seal said drain holes;

whereby, upon depression of such an umbrella tip to bear said lower stem against the floor or ground, the flange of said container will be lowered to open the drain holes and thereby discharge the collected rainwater after such rain water has drained through the radial holes of said two rings.

4. A rain-water disposer according to claim 1, particularly for use with such an umbrella of a conventional type that has a threaded tip, wherein:

each of said two collars is threaded to engage with such a threaded tip.

* * * * *